United States Patent [19]

Chasman et al.

[11] Patent Number: 4,773,920

[45] Date of Patent: Sep. 27, 1988

[54] COATED ABRASIVE SUITABLE FOR USE AS A LAPPING MATERIAL

[75] Inventors: Jonathan N. Chasman, Shoreview; Ramon F. Hegel, St. Paul; Philip E. Kendall, Woodbury; Nathan B. Postma, White Bear Lake; Douglas S. Spencer, St. Paul, all of Minn.

[73] Assignee: Minnesota Mining and Manufacturing Company, St. Paul, Minn.

[21] Appl. No.: 27,329

[22] Filed: Mar. 18, 1987

Related U.S. Application Data

[63] Continuation of Ser. No. 809,003, Dec. 16, 1985, abandoned.

[51] Int. Cl.[4] ..... B24D 11/00

[52] U.S. Cl. ..... 51/295; 51/293; 51/298; 428/411.1; 428/420

[58] Field of Search ..... 51/293, 298, 295; 428/411, 420

[56] References Cited

U.S. PATENT DOCUMENTS

| | | | |
|---|---|---|---|
| 2,655,775 | 10/1953 | Lewis | 51/281 |
| 4,038,047 | 7/1977 | Haywood | 51/295 |
| 4,046,524 | 9/1977 | van Hesden | 51/306 |
| 4,059,929 | 11/1977 | Bishop | 51/263 |
| 4,240,807 | 12/1980 | Kronzer | 51/295 |
| 4,246,003 | 1/1981 | Regler et al. | 51/293 |
| 4,255,164 | 3/1981 | Butzke et al. | 51/295 |
| 4,263,755 | 4/1981 | Globus | 51/295 |
| 4,288,233 | 9/1981 | Wiand | 51/295 |
| 4,314,827 | 2/1982 | Leitheiser et al. | 51/298 |
| 4,576,612 | 3/1986 | Shukla et al. | 51/295 |
| 4,642,126 | 2/1987 | Zador et al. | 51/295 |

*Primary Examiner*—Paul Lieberman
*Assistant Examiner*—Willie J. Thompson
*Attorney, Agent, or Firm*—Donald M. Sell; David L. Weinstein

[57] ABSTRACT

Coated abrasive comprising a backing and abrasive grain adhered to said backing by means of a binder. The binder is prepared from a composition that is curable by free-radical polymerization. The composition contains abrasive grain suspended therein at the time the composition is coated onto the backing. The abrasive exhibits high endurance for extended periods of use. The coated abrasive is prepared by a method comprising the steps of:

(a) providing a coatable composition comprising a binder curable by free-radical polymerization, said composition having lapping size abrasive grains suspended therein, (b) coating said composition on a backing, and (c) curing said composition by means of free-radical polymerization.

14 Claims, No Drawings

COATED ABRASIVE SUITABLE FOR USE AS A LAPPING MATERIAL

This is a continuation of application Ser. No. 809,003, filed Dec. 16, 1985, now abandoned.

BACKGROUND OF THE INVENTION

This invention relates to novel coated abrasives, and, in particular, to a lapping material in sheet form.

"Lapping", as the term is used in this specification, means working a particulate abrasive material against the surface of a workpiece until an exceedingly fine, mirror-like finish is imparted thereto. The objective sought is the attainment of a very smooth surface finish, while retaining a high degree of dimensional control, so that the resulting product will conform to very precise size standards. The lapping of surfaces from their original state to the final finish is a progressive operation, involving the use of a series of abrasives ranging from relatively coarse at the beginning through successively finer sizes to the end. The results secured depend upon a number of factors, such as the properties of the abrasive employed, the pressure with which the abrasive is forced against the workpiece, the pattern of movement preserved in the contact of the workpiece with the abrasive particles and other considerations.

The earliest methods of lapping employed particulate abrasive materials suspended in a liquid vehicle to form a slurry. The suspension was worked against the surface of the workpiece until the desired finish was attained. Examples of lapping methods employing abrasive slurries are described in U.S. Pat. Nos. 2,655,775; 4,059,929; 4,046,524; 4,246,003.

More recently, lapping materials in pad or sheet form have been developed. U.S. Pat. No. 4,288,233 describes lapping pads for ophthalmic lenses. While the lapping material of this invention is useful, the components thereof, i.e. diamonds, and the method of making it, i.e. metal plating, are expensive. Furthermore the lapping materials described therein are not flexible.

U.S. Pat. No. 4,255,164 discloses a glass fining sheet suited for finishing rough ground vitreous surfaces to provide a surface finish which may be readily polished comprising a flexible, conformable backing sheet bearing a microcellular abrasive granule-resin matrix which, under use conditions and in the presence of an aqueous flow, generates a fining slurry. The fining sheet is prepared by coating a flexible conformable backing sheet with a foamed liquid abrasive granule-resin coating composition comprised of liquid curable binder material, abrasive fining granules, and sufficient compatible solvent to provide a coatable composition. The coating provides a cellular layer which releases the fining abrasive granules at a controlled rate under use conditions. The released granules perform the actual abrading. The sheet of this patent appears to be another means of preparing a fining slurry.

SUMMARY OF THE INVENTION

In one aspect, the invention involves a method of preparing a coated abrasive which is especially useful as a lapping material. The method comprises the steps of:

(a) providing a coatable composition comprising a binder curable by free radical polymerization having lapping size abrasive grains suspended therein, (b) applying said coatable composition to a backing, and (c) curing said composition by means of free radical polymerization.

The curable binder is preferably curable by radiation, and it may also be curable by thermal energy. The abrasive grains are of a size typically used for lapping; i.e., they can have an average particle size of up to about 35 micrometers. The backing is preferably primed to promote adhesion between it and the cured binder. The coatable composition does not require a solvent, although a solvent may be used, if desired, for some purposes.

The method of this invention is low in cost due to the savings derived from eliminating the solvent and solvent removal steps.

In another aspect, this invention involves a coated abrasive suitable for use as a lapping material comprising a backing, lapping size abrasive grains, and a binder which adheres said grains to the backing.

The coated abrasive of this invention exhibits high endurance for extended periods of use. The coated abrasive can be die cut to shape, if desired, e.g., for specialty microfinishing apparatus.

DETAILED DESCRIPTION

As used herein, the term "curable binder" means the flowable or coatable composition from which the binder is prepared by means by free-radical polymerization; the term "binder" or "cured binder" means the dry, polymerized coating which adheres the abrasive grains to the backing.

The backing should be sufficiently strong to support the binder and abrasive grains therein under contemplated use conditions. It should be sufficiently flexible to allow mounting thereof on the surfaces of lapping tools. Because most lapping operations require the use of water or oil or both, it is preferred that the backing be water-resistant and oil-resistant. it is also preferred that the backing be smooth and of uniform caliper so the lapping film can be used successfully for finishing high precision articles. Materials suitable for the backing include water-resistant paper and polymeric films. If polymeric film is to be used as a backing, it should preferably have a primed surface to promote adhesion between the backing and the binder. The preferred primer for the purposes of this invention is ethylene acrylic acid as described in U.S. Pat. No. 3,188,265, incorporated herein by reference. Alternatively polymeric film having a roughened surface can provide excellent adhesion between the backing and binder. The preferred backing material is polyester, e.g. polyethylene terephthalate, which has been oriented and heat set and primed with ethylene acrylic acid.

The backing should be sufficiently thick to provide sufficient strength to bear the coating, but not so thick as to adversely affect flexibility. Typically, the backing should have a thickness of less than about 10 mils, and a thickness of 2 to 3 mils is preferred.

The abrasive grains can be any abrasive grain conventionally used for lapping processes. Abrasives suitable for the lapping film of this invention include iron oxide, silicon carbide, silicon nitride, silicon boride, diamond, aluminum oxide, chromic oxide, and alumina and magnesia spinel ceramic prepared in accordance with U.S. Pat. No. 4,314,827, referred to by the trademark Cubitron ®, commercially available from Minnesota Mining and Manufacturing Company, St. Paul, MN. The size range of the grains can range from about 0.2 to about 35 micrometers, the preferred range being from about 1 to about 20 micrometers. It is preferred that for a given lapping film, the grain size range be as narrow as possible, because a small number of excessively large grains can result in scratches on the workpiece surface. An excessive number of fine grains, however, will not result in this problem.

The curable binder is curable by free-radical polymerization, preferably by radiation-initiation or generation of free-radicals. Sources of radiation that are useful for the process of the present invention include ultraviolet, visible, γ-radiation, X-rays, and electron beam, with electron beam being most preferred. The curable binder can also be cured by thermal energy in the presence of an appropriate catalyst.

Suitable curable binders for use in this invention comprise radiation-curable monomers, and, optionally, reactive diluents. The curable binder may also contain conventional additives, for example, wetting agents, lubricants, dispersing agents, fillers, and coupling agents.

Radiation-curable monomers that are useful in this invention contain at least two ethylenically unsaturated moieties therein, e.g. acrylic (such as hexane diol diacrylate), methacrylate (such as hexane diol dimethacrylate).

Radiation-curable monomers that are preferred include oligomers selected from urethane acrylates and methacrylates, isocyanurate acrylates and methacrylates, polyester-urethane acrylates and methacrylates, and epoxy acrylates and methacrylates.

One class of oligomers that are preferred for the compositions for preparing the binders can be represented by the general formula:

$$R\left[NHC(=O)R'\left[OC(=O)CR''=CH_2\right]_x\right]_n$$

where n represents 2 or 3, x represents 1 to 3, inclusive

R represents an aliphatic group having, for example, from 1 to 20 carbon atoms, a cycloaliphatic group having, for example, from 5 to 6 ring carbon atoms, and up to 36 carbon atoms in total, or an aromatic group, for example benzyl, R′ represents an aliphatic group having, for example, from 2 to 10 carbon atoms, R″ represents hydrogen or a methyl group.

Exemplary reaction schemes for preparing the oligomers for the radiation-curable compositions for preparing the binders are shown below:

SCHEME 1

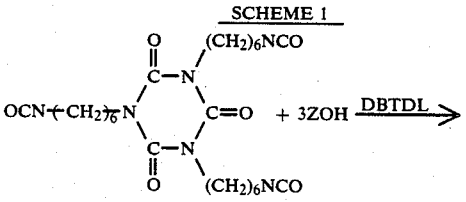

Trimer of hexamethylenediisocyanate

-continued

SCHEME 1

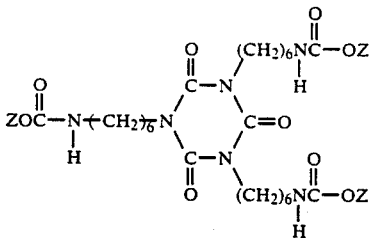

SCHEME 2

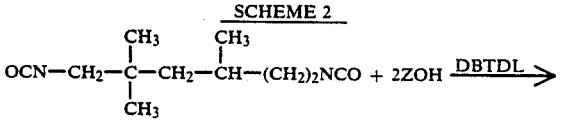

2,2,4-Trimethylhexamethylenediisocyanate

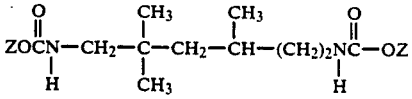

In Scheme 1 and Scheme 2, ZOH represents an aliphatic group having at least one acrylate functional group therein: Z can be represented by the structural formula $$R'\left[OC(=O)CR''=CH_2\right]_x$$

wherein R′, R″ and x are as defined above.

DBTDL represents dibutyl tin dilaurate, a catalyst.

The cyclic trimer of hexamethylene diisocyanate is commercially available from Mobay Chemical Corp. and 2,2,4-trimethylhexamethylene isocyanate is commercially available from Thorson Chemical. Representative examples of commercially available starting materials that can be characterized by the formula ZOH, supra, include pentaerythritoltriacrylate (available from Sartomer), hydroxyethyl methacrylate (available from Rohm and Haas Co.), and hydroxyethyl acrylate (available from Dow Chemical Co.).

It is preferred that a coupling agent be included with the monomer in order to promote adhesion between the abrasive grains and the cured binder. Improved adhesion between cured binder and abrasive grains inhibits the grains from being loosened and removed from the binder during lapping operations, thus enhancing the durability of the lapping film. A preferred coupling agent is γ-methacryloxypropyl trimethoxy silane commercially available from Dow Corning Corp. under the trade designation Z6030 and Union Carbide Corp. under the trade designation A-174. Preferably, the amount of coupling agent ranges from about 0.1 to about 10% by weight, preferably from about 1.5 to about 5% by weight, based on weight of abrasive grains.

It is also preferred to include a reactive diluent with the monomer. Reactive diluents suitable for the present invention include mono- or multifunctional acrylates and methacrylates such as hexane diol diacrylate (HDDA), pentaerythritol triacrylate ($PET_3A$), pentaerythritol tetracrylate ($PET_4A$), trimethylolpropanetriacrylate (TMPTA), β-hydroxyethylmethacrylate (HEMA), tetrahydrofuran acrylate (THF-A) the preferred specie. The reactive diluent serves to reduce the viscosity of the composition for preparing the binder, thus improving the coatability of the composition, and to modify the hardness of the cured binder. Preferably, the ratio of monomer to reactive diluent is 85:15 to 25:75, more preferably, the ratio is 75:25 to 35:65, and most preferably, the ratio is 65:35 to 45:55.

The cured binder can have a Knoop hardness, as measured on a Tukon® indentation tester, from about 1 to about 50. The Knoop hardness preferably ranges from about 7 to about 25.

The cured binder should be compatible with the backing and primer thereon, i.e. the binder should be free of fisheyes, craters, voids, and orange-peels when coated and cured.

The coated abrasive of this invention can vary with respect to product requirements. Depending upon the function of the coated abrasive, the user can specify hardness of cured binder and size of abrasive grains. For example, ophthalmic pads are characterized by a very hard resin combined with a relatively coarse mineral. Disc burnishing films are characterized by softer resin and finer mineral.

The coated abrasive of this invention can be prepared by applying the curable binder and abrasive grains suspended therein onto the backing to form a coating and then curing the thus-applied coating by free-radical polymerization. The following method has been found to be useful in preparing the coated abrasive.

It is preferred that the dry mineral grains first be treated with coupling agent. After the mineral grains are treated with coupling agent, they are then heat set in an oven. Typically, heat setting is conducted at 60° C.–100° C. for 1½ to 2½ hours. Alternatively, the coupling agent can be mixed in the curable binder along with the dry mineral grains.

After the monomers and the reactive diluents, if any, are blended to form the curable binder, the grains of abrasive mineral are added to the curable binder under conditions of high-shear mixing. The composition is then applied, preferably by means of conventional coating equipment, to the backing. The viscosity of the composition determines the ease of coating. The viscosity of the composition can range from about 200 to about 5,000,000 centipoise at 25° C., preferably about 2000 to about 500,000. At higher temperatures, more viscous compositions can be used. For example, a composition having a viscosity of 30,000 centipoise at 25° can be coated fairly easily at 50° C. Rotogravure coating is preferred for the reason that the rotogravure coater can impart a uniform pattern of ridges and valleys to the binder composition, which, after the composition is cured, can serve as channels for flow of lubricants and for removal of abraded material. The coating is then cured by means of free-radical polymerization. Preferably, the free-radical polymerization is initiated by actinic radiation, preferably electron beam. However, other sources of radiation, such as ultraviolet, visible, and gamma, are also suitable with appropriate catalyst. Thermal initiation is also suitable with an appropriate catalyst.

It should be noted that solvents are not required to be added to the curable binder to facilitate coating thereof onto the backing. This has the advantage of avoiding troublesome solvent removal problems. If desired, an inert solvent can be employed along with the monomers, reactive diluents, and coupling agent of the curable binder.

In order to demonstrate the performance characteristics of the coated abrasive of the present invention, ophthalmic pads were prepared and tested. The testing procedures were designated as (a) first fine, (b) second fine, and (c) single fine. These testing procedures are designed to measure the amount of material removed and the character of finish imparted to a plastic CR-39 lens. First fine samples were prepared and tested according to the following procedure:

The backside of the material to be tested was laminated with a pressure-sensitive adhesive. An ophthalmic test daisy was die cut with a standard die. The test daisy was mounted on a 2.12 diopter spherical lapping block. The lapping block was mounted on a Coburn Rocket lapping machine. The initial thickness of the lens was measured, and then the lens was clamped over the lapping block, air pressure was set at 20 psi. The lens and lapping blocks were flooded with water. A one minute test was run at settings of "medium" and "20 mm top stroke". The lens was removed and final thickness measured. Finish was measured with a Surtronic 3 instrument.

Second fine samples were prepared and tested according to the same procedure, the only difference being that the test was run for two minutes, instead of one minute, and a 6.25/8.25 diopter lapping block was used.

Since fine were prepared and tested according to same procedure as the first fine, the only difference being that the test was run for three minutes, instead of one minute.

In the examples which follow, the following abbreviations will be used:

HMDIT-A5:

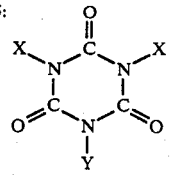

wherein

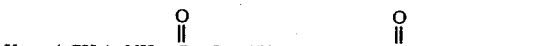

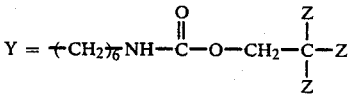

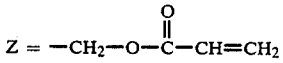

HMDIT-A9:

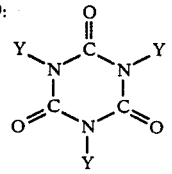

wherein Y is as defined above.

TMDI-A4:

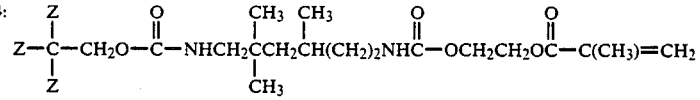

wherein Z is as defined above.

TMDI-A6:

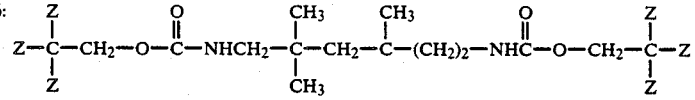

wherein

Z is as defined above.

n-BUMA: n-butyl(2-methacryloxy)ethyl carbamate

THF-A: tetrahydrofurfuryl acrylate

HDDA: hexane diol diacrylate

TMPTA: trimethylolpropanetriacrylate $PET_3A$: pentaerythritol triacrylate $PET_4A$: pentaerythritol tetracrylate

Preparation of HMDIT-A5

To one-gallon reaction vessel equipped with a thermometer, mechanical stirrer, and a dry air sparge was charged 6.5 equivalent of the trimer of hexamethylene diisocyanate ("Desmondur-N-3390"). In a second vessel, 2.5 g tetra-cis-methylene-3,3,5-di-t-butyl-4-hydroxyphenylpropionatemethane ("Irganox 1010") was dissolved with heat and stirring into 4.6 equivalent of hydroxyethylmethacrylate (HEMA). Dibutyltindilaurate (8 to 10 drops) was then charged to the vessel containing HEMA. The contents of the second vessel were charged to the reaction vessel over a 30 minute period in such a manner, with cooling, that the reaction temperature is maintained at about 70° C. At the end of the 30-minute period, 2.3 equivalents of pentaerythritoltriacrylate ("Sartomer") was added to the reaction vessel over a 15 minute period. Heat was applied to maintain a reaction temperature of 70°–80° C. until the reaction was complete as determined by % NCO.

Preparation of TMDI-A4

To a one gallon reaction vessel equipped with a thermometer, mechanical stirrer, and a dry air sparge was charge 10 equivalents of 2,2,4-trimethylhexamethylenediisocyanate. In a second vessel, 3.0 g of tetra-cis-methylene-3,3,5-di-t-butyl-4-hydroxyphenylpropionatemethane ("Irganox 1010") was dissolved with heat and stirring into 5.35 equivalents of hydroxyethylmethacrylate (HEMA). Dibutyltindilaurate (8 to. 10 drops) was then charged to the vessel containing HEMA. The contents of the second vessel were charged to the reaction vessel over a 30 minute period in such a manner, with cooling, that the reaction temperature was maintained at about 70° C. At the end of the 30-minute period, 5.0 equivalents of pentaerythritoltriacrylate ("Sartomer") was added to the reaction vessel over a 15 minute period. Heat was applied to maintain a reaction temperature of 70°–80° C. until the reaction was complete as determined by % NCO.

Preparation of TMDI-A6

To a one gallon reaction vessel equipped with a thermometer, mechanical stirrer, and a dry air sparge was charged 7.0 equivalents of 2,2,4-trimethylhexamethylene diisocyanate. In a second vessel, 3.0 g of tetra-cis-methylene-3,3,5-di-t-butyl-4-hydroxyphenylpropionatemethane ("Irganox 1010") was dissolved with heat and stirring, into 7.3 equivalents of pentaerythritoltriacrylate ("Sartomer"). Dibutyltindilaurate (8 to 10 drops) was then charged to the vessel containing the $PET_3A$. The contents of the second vessel were charged to the first over a 30 min. period, with heating and cooling, to maintain a temperature of 70° C. The reaction mixture was heated to maintain a temperature of 70°–80° C. until the reaction is complete by % NCO.

Preparation of n-BUMA

To a one gallon reaction vessel equipped with a thermometer, mechanical stirrer, and a dry air sparge was charged 10 equivalents of n-butylisocyanate. In a second vessel, 2.5 g tetra-cis-methylene-3,3,5-di-t-butyl-4-hydroxyphenylpropionatemethane ("Irganox 1010") was dissolved with heat and stirring into 11 equivalents of hydroxyethylmethacrylate (HEMA). Dibutyltindilaurate (8 to 10 drops) was then charged to the vessel containing HEMA. The contents of the second vessel were charged to the reaction vessel over a 30 minute period in such a manner, with cooling, that the reaction temperature was maintained at about 70° C. until the reaction was complete as determined by % NCO.

Preparation of HMDIT-A9

To a one gallon reaction vessel equipped with a thermometer, mechanical stirrer, and a dry air sparge was charged 5.0 equivalents of the trimer of hexamethylenediisocyanate ("Desmondur-N-3390"). In a second vessel, 3.0 g tetra-cis-methylene-3,35-di-t-butyl-4-hydroxyphenylpropionatemethane ("Irganox 1010") was dissolved with heat and stirring into 5.25 equivalents of pentaerythritoltriacrylate ($PET_3A$). Dibutyltindilaurate (8 to 10 drops) was then charged to the vessel containing $PET_3A$. The contents of the second vessel were charged to the reaction vessel over a 30 minute period in such a manner, with cooling, and then heating, that the reaction temperature was maintained at about 70° C. until the reaction was complete as determined by % NCO.

The following examples, which are illustrative rather than limiting or delineative of the scope of the invention, serve to describe the novel compounds, their method of preparation, and their properties.

EXAMPLE 1

The following runs demonstration the effect of reactive diluent and the percentage thereof in the binder of the coated abrasive of the present invention.

In the following runs, to a mixture containing 100 g of monomer and reactive diluent in the ratios as shown in Table I below was added 250 g $Al_2O_3$ (20 micrometers) which had been pretreated with 2% gamma-methacryloxy propyl trimethoxysilane (Z-6030), based on the weight of $Al_2O_3$. The resulting composition was coated at 1 mil thickness on ethylene acrylic acid primed polyethylene terephthalate film. The coated film was subjected to electron beam radiation at 250 kev, 8 Mrad.

The performance characteristics of the coated abrasives thus prepared are shown in Table I.

TABLE I

| Monomer | Reactive diluent | Ratio of monomer to diluent | Viscosity (cps) Unfilled | Viscosity (cps) Filled | Ophthalmic cuts (mm) First fine | Ophthalmic cuts (mm) Second fine | Ophthalmic cuts (mm) Single fine |
|---|---|---|---|---|---|---|---|
| HMDIT-A5 | n-BUMA | 40:60 | 600 | 39000 | 0.095 | 0.160 | 0.160 |
| HMDIT-A5 | THF-A | 40:60 | 116 | 11000 | 0.070 | 0.088 | 0.150 |
| TMDI-A4 | THF-A | 70:30 | 150 | 10800 | 0.158 | 0.221 | 0.360 |
| TMDI-A4 | HDDA | 70:30 | 238 | 12300 | 0.156 | 0.253 | 0.325 |
| HMDIT-A9 | THF-A | 40:60 | 300 | 6000 | 0.095 | 0.155 | 0.155 |
| 15 micrometer 3 M Microabrasive Paper S/C (Control) | | | | | 0.460 | | |
| 12 micrometer Imperial Lapping Film A/O TP 3 mil (Control) | | | | | | 0.050 | |
| 15 micrometer Microabrasive Film A/O 2 mil (Control) | | | | | | | 0.393 |

The coated abrasive of the present invention exhibited improved results according to the second fine test procedure, as the cut was dramatically increased while finish and abrasive wear continued to be acceptable.

EXAMPLE 2

This example demonstrates the effect of coupling agent on the coated abrasive of the present invention.

In the following runs, to a mixture containing 100 g of monomer and reactive diluent in the ratio 1:1 (by weight) was added 150 g $Al_2O_3$ (12 micrometers). In the control run, no coupling agent was employed. In the second run 1% by weight of coupling agent, based on weight of abrasive grains, was used to pretreat the $Al_2O_3$ abrasive. The compositions were knife coated at 1 mil thickness on ethylene acrylic acid primed polyethylene terephthalate film. The coated film was subjected to electron beam radiation at 240 Kev, 9 Mrad. The performance characteristics of the coated abrasive thus prepared are shown in Table II.

TABLE II

| Coupling agent | Viscosity (cps) | Flat Lap Test: No. of passes to endpoint (1000 cycles/pass) | Flat Lap Test: Total cut at end (mg) |
|---|---|---|---|
| None | 5960 | 1 | 49.5 |
| Z6030 | 4560 | 10 | 246.5 |

The addition of a coupling agent resulted in an improvement in the durability, and, consequently, the performance of the coated abrasive as well as a reduction in the viscosity of the coating composition.

EXAMPLE 3

This example demonstrates the preferred combination of monomer, reactive diluent, coupling agent, and abrasive grain. In the following runs, the monomers, and reactive diluents were blended, and abrasive grains pretreated with gamma-methacryloxypropyltrimethoxysilane coupling agent (Z6030) was introduced into the mixture. Dyes were also utilized in the mixtures so that the size of the abrasive grains in each run could be identified. The ratios of ingredients are set forth in Table III.

TABLE II

| Run | Monomer | Reactive diluent | Ratio of monomer to diluent | Abrasive grain | Ratio of grain to binder | Percentage of coupling agent based on weight of grain | Dye[a] | Percentage of dye based on binder weight |
|---|---|---|---|---|---|---|---|---|
| 1 | TMDI-A6 | THF-A | 60:40 | $Al_2O_3$ (5 μm) | 2.5/1 | 3 | A | 0.64 |
| 2 | TMDI-A6 | THF-A | 60:40 | $Al_2O_3$ (9 μm) | 2.5/1 | 3 | B | 0.35 |
| 3 | TMDI-A6 | TMPTA | 70:30 | $Al_2O_3$ (12 μm) | 2.5/1 | 2 | C | 2.28 |
| 4 | TMDI-A6 | TMPTA | 70:30 | $Al_2O_3$ (15 μm) | 2.5/1 | 2 | D | 0.5 |

[a]A: Mixture of 1 part Hytherm Black B (Morton Chemical), 1 part Calco Oil Red Y Liquid (American Cyanamid Co.), 2 parts Perox #9 Yellow (Morton Chemical)
B: Hytherm B-200% Blue (Morton Chemical)
C: Perox #9 Yellow (Morton Chemical)
D: Savinyl Orange RLS (Sandoz Chemical)

The compositions were knife coated at 1 mil thickness on ethylene acrylic acid primed polyethylene terephthalate film. The coated film was subjected to electron beam radiation at 250 Kev, 8 Mrad.

The performance characteristics of the coated abrasives thus prepared are shown in Table IV.

TABLE IV

| Run[a] | Ophthalmic cuts (mm) Second fine | Ophthalmic cuts (mm) Single fine | Flat lap test[b] Total cut at end (mg) |
|---|---|---|---|
| 1 | 0.035 | — | 27.3 |
| 2 | 0.100 | — | 66.6 |
| 3 | — | .314 | 584.0 |
| 4 | — | .500 | 926.0 |
| Control 1 | 0.021 | — | 8.40 |
| Control 2 | 0.020 | — | 17.28 |
| Control 3 | 0.050 | — | 156.1 |
| Control 4 | — | 0.393 | 574.3 |

[a]Control 1 was 5 micrometer Imperial Lapping Film A/O TP 3 mil. Control 2 was 9 micrometer Imperial Lapping Film A/O TP 3 mil. Control 3 was 12 micrometer Imperial Lapping Film A/O TP 3 mil. Control 4 was 15 micrometer Microabrasive Film A/O 2mil.
[b]5000 cycles Various modifications and alternations of this invention will become apparent to those skilled in the art without departing from the scope and spirit of this invention, and it should be understood that this invention is not to be unduly limited to the illustrative embodiments set forth herein.

What is claimed is:

1. A coated abrasive suitable for use as a lapping material, said coated abrasive comprising (a) a backing, and (b) an abrasive coating adhered to said backing, said abrasive coating being formed by coating a suspension comprising lapping size abrasive grains and binder curable by free-radical polymerization onto said backing and curing said binder by free-radical polymerization.

2. The coated abrasive of claim 1 wherein said abrasive grains have an average size of from about 0.3 to about 35 micrometers.

3. The coated abrasive of claim 2 wherein said curable binder comprises a monomer having at least two ethylenically unsaturated moieties.

4. The coated abrasive of claim 3 wherein said monomer is selected from the group consisting of urethane acrylates, urethane methacrylates, isocyanurate acrylates, isocyanurate methacrylates, polyester-urethane acrylates, polyester-urethane methacrylates, epoxy acrylates, and epoxy methacrylates.

5. A coated abrasive suitable for use as a lapping material, said coated abrasive comprising (a) a backing, and (b) an abrasive coating adhered to said backing, said abrasive coating being formed by coating a suspension comprising lapping size abrasive grains and binder curable by free-radical polymerization onto said backing and curing said binder by free-radical polymerization, wherein said curable binder includes a coupling agent.

6. The coated abrasive of claim 5 wherein said coupling agent is $\gamma$-methacryloxypropyl trimethoxy silane.

7. The coated abrasive of claim 1 wherein said curable binder includes a reactive diluent.

8. The coated abrasive of claim 7 wherein said reactive diluent is selected from the group consisting of hexane diol diacrylate, pentaerythritol triacrylate, trimethylolpropane triacrylate, $\beta$-hydroxyethylmethacrylate, and tetrahydrofuran acrylate.

9. Method of preparing a coated abrasive comprising the steps of:

(a) providing a coatable composition comprising a binder curable by free-radical polymerization having lapping size abrasive grains suspended therein, (b) coating said coatable composition on a backing, and (c) curing said composition by means of free-radical polymerization.

10. The method of claim 9 wherein said composition is cured by means of actinic radiation.

11. The method of claim 9 wherein said composition is cured by means of thermal energy.

12. The method of claim 9 wherein said composition comprises a monomer having at least two ethylenically unsaturated moieties.

13. The method of claim 9 wherein said composition includes a reactive diluent.

14. Method of preparing a coated abrasive comprising the steps of:

(a) providing a coatable composition comprising a binder curable by free-radical polymerization having lapping size abrasive grains suspended therein, (b) coating said coatable composition on a backing, and (c) curing said composition by means of free-radical polymerization, wherein said composition includes a coupling agent.

* * * * *

UNITED STATES PATENT AND TRADEMARK OFFICE

CERTIFICATE OF CORRECTION

PATENT NO. : 4,773,920

DATED : September 27, 1988

INVENTOR(S) : Jonathan N. Chasman et al

It is certified that error appears in the above-identified patent and that said Letters Patent is hereby corrected as shown below:

Col. 4, line 68, "tetracrylate" should read --tetraacrylate--.

Col. 6, line 32, "Since" should read --Single--.

Col. 8, line 61, "demonstration" should read --demonstrate--.

Signed and Sealed this

Twenty-fifth Day of July, 1989

*Attest:*

*Attesting Officer*

DONALD J. QUIGG

*Commissioner of Patents and Trademarks*

US004773920B1

REEXAMINATION CERTIFICATE (2552nd)

United States Patent [19]

Chasman et al.

[11] B1 4,773,920

[45] Certificate Issued May 2, 1995

[54] COATED ABRASIVE SUITABLE FOR USE AS A LAPPING MATERIAL

[75] Inventors: Jonathan N. Chasman, Shoreview; Ramon F. Hegel, St. Paul; Philip E. Kendall, Woodbury; Nathan B. Postma, White Bear Lake; Douglas S. Spencer, St. Paul, all of Minn.

[73] Assignee: Minnesota Mining and Manufacturing Company, St. Paul, Minn.

Reexamination Request:
No. 90/003,371, Mar. 28, 1994

Reexamination Certificate for:

| | |
|---|---|
| Patent No.: | **4,773,920** |
| Issued: | **Sep. 27, 1988** |
| Appl. No.: | **27,329** |
| Filed: | **Mar. 18, 1987** |

Certificate of Correction issued Jul. 25, 1989.

Related U.S. Application Data

[63] Continuation of Ser. No. 809,003, Dec. 16, 1985, abandoned.

[51] Int. Cl.[6] ..... B24D 11/00

[52] U.S. Cl. ..... 51/295; 51/293; 51/298; 428/411.1; 428/420

[56] References Cited

U.S. PATENT DOCUMENTS

| | | | |
|---|---|---|---|
| 4,047,903 | 9/1977 | Hesse et al. | 51/298 |
| 4,389,433 | 6/1983 | Pampalone | 427/341 |
| 4,485,226 | 11/1984 | Noll et al. | 528/45 |

FOREIGN PATENT DOCUMENTS

| | | |
|---|---|---|
| 2200773 | 4/1974 | France . |
| 3317882 | 11/1984 | Germany . |
| 52-65391 | 5/1977 | Japan . |
| 2087263 | 5/1982 | United Kingdom . |
| 2137118 | 10/1984 | United Kingdom . |

*Primary Examiner*—Deborah Jones

[57] ABSTRACT

Coated abrasive comprising a backing and abrasive grain adhered to said backing by means of a binder. The binder is prepared from a composition that is curable by free-radical polymerization. The composition contains abrasive grain suspended therein at the time the composition is coated onto the backing. The abrasive exhibits high endurance for extended periods of use. The coated abrasive is prepared by a method comprising the steps of:

(a) providing a coatable composition comprising a binder curable by free-radical polymerization, said composition having lapping size abrasive grains suspended therein, (b) coating said composition on a backing, and (c) curing said composition by means of free-radical polymerization.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 4 and 12 are cancelled.

Claims 1, 5, 9 and 14 are determined to be patentable as amended.

Claims 2, 6–8, 10–11 and 13 dependent on an amended claim, are determined to be patentable.

New claims 15 and 16 are added and determined to be patentable.

1. A coated abrasive suitable for use as a lapping material, said coated abrasive comprising (a) a backing; and (b) an abrasive coating adhered to said backing, said abrasive coating being formed by coating a suspension comprising lapping size abrasive grains and binder curable by free-radical polymerization onto said backing and curing said binder by free-radical polymerization, *wherein said binder is selected from the group consisting of isocyanurate acrylates, isocyanurate methacrylates, diisocyanate acrylates, and diisocyanate methacrylates.*

5. A coated abrasive suitable for use as a lapping material, said coated abrasive comprising (a) backing, and (b) an abrasive coating adhered to said backing, said abrasive coating being formed by coating a suspension comprising lapping size abrasive grains and binder curable by free-radical polymerization onto said backing and curing said binder by free-radical polymerization, wherein said curable binder includes a coupling agent, *wherein said binder is selected from the group consisting of isocyanurate acrylates, isocyanurate methacrylates, diisocyanate acrylates, and diisocyanate methacrylates.*

9. Method of preparing a coated abrasive comprising the steps of:

(a) providing a coatable composition comprising a binder curable by free-radical polymerization having lapping size abrasive grains suspended therein, *wherein said binder is selected from the group consisting of isocyanurate acrylates, isocyanurate methacrylates, diisocyanate acrylates, and diisocyanate methacrylates,*

(b) coating said coatable composition on backing, and (c) curing said composition by means of free-radical polymerization.

14. Method of preparing a coated abrasive comprising the steps of:

(a) providing a coatable composition comprising a binder curable by free-radical polymerization having lapping size abrasive grains suspended therein, *wherein said binder is selected from the group consisting of isocyanurate acrylates, isocyanurate methacrylates, diisocyanate acrylates, and diisocyanate methacrylates,*

(b) coating said coatable composition on a backing, and (c) curing said composition by means of free-radical polymerization, wherein said composition includes a coupling agent.

*15. The coated abrasive of claim 1 wherein said isocyanurate acrylates, isocyanurate methacrylates, diisocyanate acrylates, and diisocyanate methacrylates are selected from the group consisting of:*

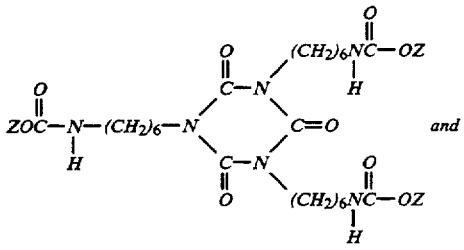

*and*

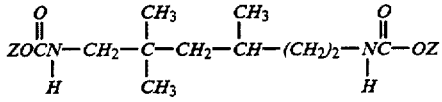

*wherein Z is represented by the following formula:*

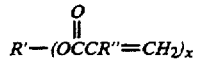

*wherein x represents an integer from 1 to 3, inclusive,*

*R' represents an aliphatic group having from 2 to 20 carbon atoms, and*

*R" represents hydrogen or a methyl group.*

*16. The coated abrasive of claim 5 wherein said acrylated isocyanurate acrylates, isocyanurate methacrylates, diisocyanate acrylates, and diisocyanate methacrylates are selected from the group consisting of:*

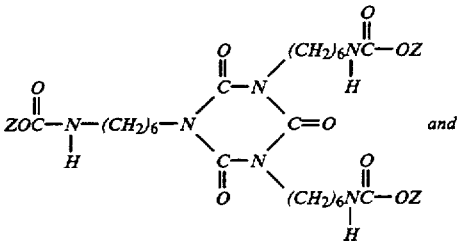

*and*

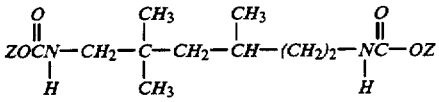

*wherein Z is represented by the following formula:*

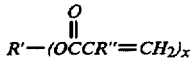

*wherein x represents an integer from 1 to 3, inclusive,*

*R' represents an aliphatic group having from 2 to 20 carbon atoms, and*

*R" represents hydrogen or a methyl group.*

* * * * *